US008303328B2

(12) United States Patent
Meynier

(10) Patent No.: US 8,303,328 B2
(45) Date of Patent: Nov. 6, 2012

(54) CONNECTION ASSEMBLY

(75) Inventor: Christophe Meynier, Varces (FR)

(73) Assignee: Radiall, Rosny-Sous-Bois (FR)

( * ) Notice: Subject to any disclaimer, the term of this patent is extended or adjusted under 35 U.S.C. 154(b) by 83 days.

(21) Appl. No.: 12/960,011

(22) Filed: Dec. 3, 2010

(65) Prior Publication Data

US 2011/0143575 A1 Jun. 16, 2011

(30) Foreign Application Priority Data

Dec. 11, 2009 (FR) ..... 09 58902
May 18, 2010 (FR) ..... 10 53834

(51) Int. Cl.
*H01R 13/62* (2006.01)

(52) U.S. Cl. ..... 439/370

(58) Field of Classification Search ..... 439/108, 439/370, 578–585, 313
See application file for complete search history.

(56) References Cited

U.S. PATENT DOCUMENTS

| | | | | |
|---|---|---|---|---|
| 3,517,371 | A | 6/1970 | Buckley | |
| 4,508,408 | A | 4/1985 | Shepler et al. | |
| 5,795,188 | A * | 8/1998 | Harwath | 439/583 |
| 7,347,727 | B2 * | 3/2008 | Wlos et al. | 439/578 |
| 7,429,199 | B2 * | 9/2008 | Burgess | 439/841 |
| 7,547,215 | B1 * | 6/2009 | Mark et al. | 439/66 |
| 7,934,953 | B1 * | 5/2011 | Solis | 439/578 |
| 2007/0026703 | A1 | 2/2007 | Taga et al. | |

FOREIGN PATENT DOCUMENTS

| | | |
|---|---|---|
| DE | 20 2008 013 794 U1 | 4/2009 |
| FR | 2.003.198 | 11/1969 |
| WO | WO 2006/027275 A1 | 3/2006 |

OTHER PUBLICATIONS

French Search Report dated Jul. 20, 2010 issued in French Patent Application No. 0958902 (with translation).
French Search Report dated Nov. 8, 2010 issued in French Patent Application No. 1053834 (with translation).

* cited by examiner

*Primary Examiner* — Edwin A. Leon
(74) *Attorney, Agent, or Firm* — Oliff & Berridge, PLC

(57) ABSTRACT

The present invention provides a device for connecting together first and second complementary connector elements, the device comprising first and second parts that are movable in rotation relative to each other, wherein the device comprises a spring having a first end connected to the first part and a second end connected to the second part; the spring, the first part, and the second part being such that turning the first part in a first direction of rotation, or turning the second part in a second direction of rotation opposite to the first direction of rotation increases the inside diameter of the spring; and the spring, the first part, and the second part being such that turning the first part in the second direction of rotation or turning the second part in the first direction of rotation decreases the inside diameter of the spring.

19 Claims, 5 Drawing Sheets

CONNECTION ASSEMBLY

FIELD OF THE INVENTION

The present invention relates to a device for connecting together two complementary connector elements, e.g. a plug to a socket or to an outlet for wiring. By way of example, the connector elements may be coaxial elements, in particular a coaxial plug and a coaxial socket.

BACKGROUND OF THE INVENTION

It is known to make such a connection by means of a ring that is mounted to turn on a plug, the ring including a thread for screwing onto a corresponding thread of the socket. The ring is tightened and loosened by turning it in two opposite directions of rotation.

Such solutions do not serve to avoid unwanted loosening of the ring, where such loosening affects the connection that is made and occurs in particular under the effect of vibration or of rotation of the cable on which the plug is mounted.

There exists a need to have a device for connecting a plug to a socket that reduces the risk of unwanted loosening.

OBJECT AND SUMMARY OF THE INVENTION

Exemplary embodiments of the invention provide a device for connecting together first and second complementary connector elements, in particular a plug and a socket, the device comprising first and second parts that are movable in rotation relative to each other, wherein the device comprises a spring having a first end connected to the first part and a second end connected to the second part; the spring, the first part, and the second part being such that turning the first part in a first direction of rotation, or turning the second part in a second direction of rotation opposite to the first direction of rotation increases the inside diameter of the spring; and the spring, the first part, and the second part being such that turning the first part in the second direction of rotation or turning the second part in the first direction of rotation decreases the inside diameter of the spring.

By means of these exemplary embodiments of the invention, the first and second parts act in complementary manner relative to each other for connecting or disconnecting the two elements that are to be connected together by means of the device.

The invention makes it possible to reduce the risk of the first and second connector elements being loosened by the vibration and/or torque suffered by the cable connected to one of the complementary connector elements.

In first exemplary embodiments of the invention, the first part may include a threaded portion wound in the opposite winding direction to the winding direction of the spring. The winding direction of the thread of the first part and the winding direction of the spring may thus be different, the first part having a right-handed or left-handed thread, for example, while the spring is respectively wound left-handedly or right-handedly.

The first part may extend along a longitudinal axis, the first end of the spring may be received in a first hole formed in the wall of the first part close to a longitudinal end of the first part, and the second end of the spring may pass through a second hole formed in the wall of the first part at a distance from said longitudinal end.

The first hole may be located longitudinally between said longitudinal end and the second hole. By way of example, said longitudinal end is the end that is to come into contact with the second connector element when connecting it to the first connector element on which the device is mounted.

Such a configuration of the first part, the second part, and the spring makes possible the above-mentioned complementary operation of the first and second parts.

In second exemplary embodiments of the invention, the device includes a threaded portion wound in the same winding direction as the winding direction of the spring. The first part may extend along a longitudinal axis, the first end of the spring may be received in a first hole formed in the wall of the first part at a distance from a longitudinal end of the first part, and the second end of the spring may pass through a second hole formed in the wall of the first part close to said longitudinal end.

The second hole may be located longitudinally between said longitudinal end and the first hole. By way of example, said longitudinal end is the end that is to come into contact with the second connector element while it is being connected to the first connector element on which the device is mounted.

Such a configuration of the first part, of the second part, and of the spring makes possible the above-mentioned complementary operation of the first and second parts.

The threaded portion of the second exemplary embodiments of the invention may be provided in the first part.

In a variant, the threaded portions of the second exemplary embodiments of the invention are provided in the spring. The threaded portion may for example be provided in the inside surface of the spring.

In this variant, the complementary operation of the first and second parts is made possible by the configuration of the spring, the spring serving on its own to engage the first and second connector elements and to prevent one from being loosened relative to the other.

When the threaded portion wound in the same direction as the spring is carried by said spring, it is no longer necessary to provide such a threaded portion on the first part, thereby making it possible to shorten the length of the first part and thus to reduce its weight. It is possible to obtain a device that is lighter in weight and more compact. The spring is advantageously received inside the first and second parts. The spring may be a helical spring. The spring may be made using a wire of cylindrical section, or in a variant using a flat ribbon.

In particular when it carries the threaded portion, the spring may also be made using a wire of trapezoidal section, where such a section provides better co-operation with a complementary threaded portion.

The second hole may present an angular dimension that is greater than the diameter of the wire of the spring.

The second part may comprise at least a portion surrounding at least the outside of a portion of the first part. By way of example, the first part is a ring and the second part may be a ring or a fraction of the ring, e.g. of greater or lesser extent.

Other exemplary embodiments of the invention also provide an assembly comprising:

- a first connector element, in particular a plug;
- a second connector element, complementary to the first connector element, in particular a socket; and
- a device mounted on the first connector element and suitable for connecting it to the second connector element.

The inside diameter of the spring at rest may be less than the greatest transverse dimension of the second connector element.

The second connector element may include a threaded portion complementary to that of the device, in such a manner that the two threaded portions are capable of co-operating. When the threaded portion of the device is carried by the spring, its pitch may be selected to co-operate with the pitch of the complementary threaded portion.

When the threaded portion of the device is carried by the spring, the inside diameter of the spring at rest may be configured to exert friction on the complementary threaded portion.

Below and above, the term "spring at rest" designates the configuration of the spring while it is not resting against the second connector element and while it is not subjected to any external force tending to modify its inside diameter.

The term "greatest transverse dimension of the second connector element" is used to designate the greatest outside transverse dimension, relative to the longitudinal axis of the second connector element, of the portion of the second connector element that comes into contact with the first connector element during connection.

The angular distance over which the second hole extends in the wall of the first part may be greater than or equal to the angle through which the second end of the spring rotates to enable the inside diameter of the spring to be brought to a value that is greater than the greatest transverse dimension of the second connector element.

Turning the first part in the first direction of rotation serves not only to fasten, and in particular to screw, the first part onto the second connector element, but also, as a result of the friction between the spring and the outside surface of the second connector element, to increase the inside diameter of the spring, enabling the spring to be positioned around the fraction of the second connector element that presents the greatest transverse dimension. Once the spring is in place around said fraction of the second connector element, in the event of the first part ceasing to turn, the spring presses against the second connector element, then being prestressed thereagainst and exerting a clamping force thereon.

If an operator then turns the first part in the second direction of rotation opposite to the first, the reduction in the inside diameter of the spring further increases the clamping thereof against the second connector element, making any unwanted loosening impossible. In order to disconnect the two elements of the connector, an operator can then act on the second part in the second direction of rotation, thereby increasing the inside diameter of the spring, thus enabling the assembly to be disconnected.

The first part and/or the second part may be made of plastics material.

The first connector element, e.g the plug, and the device may be two distinct parts.

In a variant, the first connector element, e.g the plug, and the device may be made as a single part.

The two complementary connector elements may be coaxial elements or multicontact elements.

BRIEF DESCRIPTION OF THE DRAWINGS

The invention can be better understood from the following description of non-limiting embodiments thereof and on examining the accompanying drawings, in which.

MORE DETAILED DESCRIPTION

Figure 1:
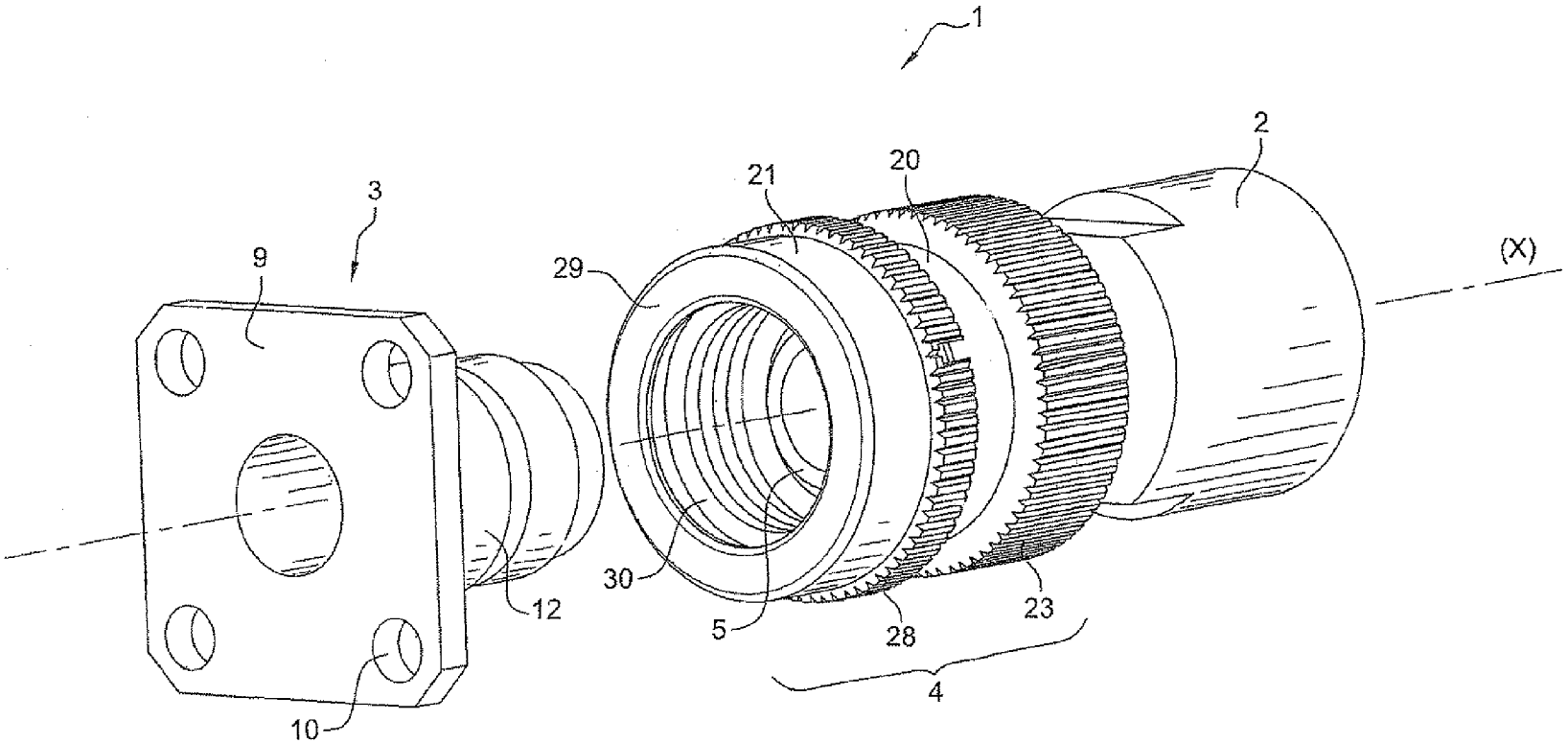
FIG. 1 is a perspective view of an assembly in a first embodiment of the invention shown diagrammatically.

FIG. 1 shows an assembly given overall reference 1 in a first embodiment of the invention.

This assembly 1 comprises a first connector element 2 suitable for being connected to a complementary, second connector element, given overall reference 3, by means of a device that is given overall reference 4. In the example described, but in non-limiting manner, the first connector element 2 is a plug and the second connector element 3 is a socket. In a variant, the second connector element 3 is an outlet for wiring.

In the example described, the plug 2 and the socket 3 are coaxial elements of internal structure that comprises a central contact received in an outer contact with insulation interposed between them (not shown in FIGS. 1 to 4 for reasons of clarity).

By way of example, the plug 2 is generally tubular in shape about a longitudinal axis X, presenting a cross-section that decreases in steps on approaching the front end 5 of the plug 2, said end 5 designating the longitudinal end of the plug 2 that comes into contact with the socket 3 when the plug 2 is connected to the socket 3.

Figure 3:
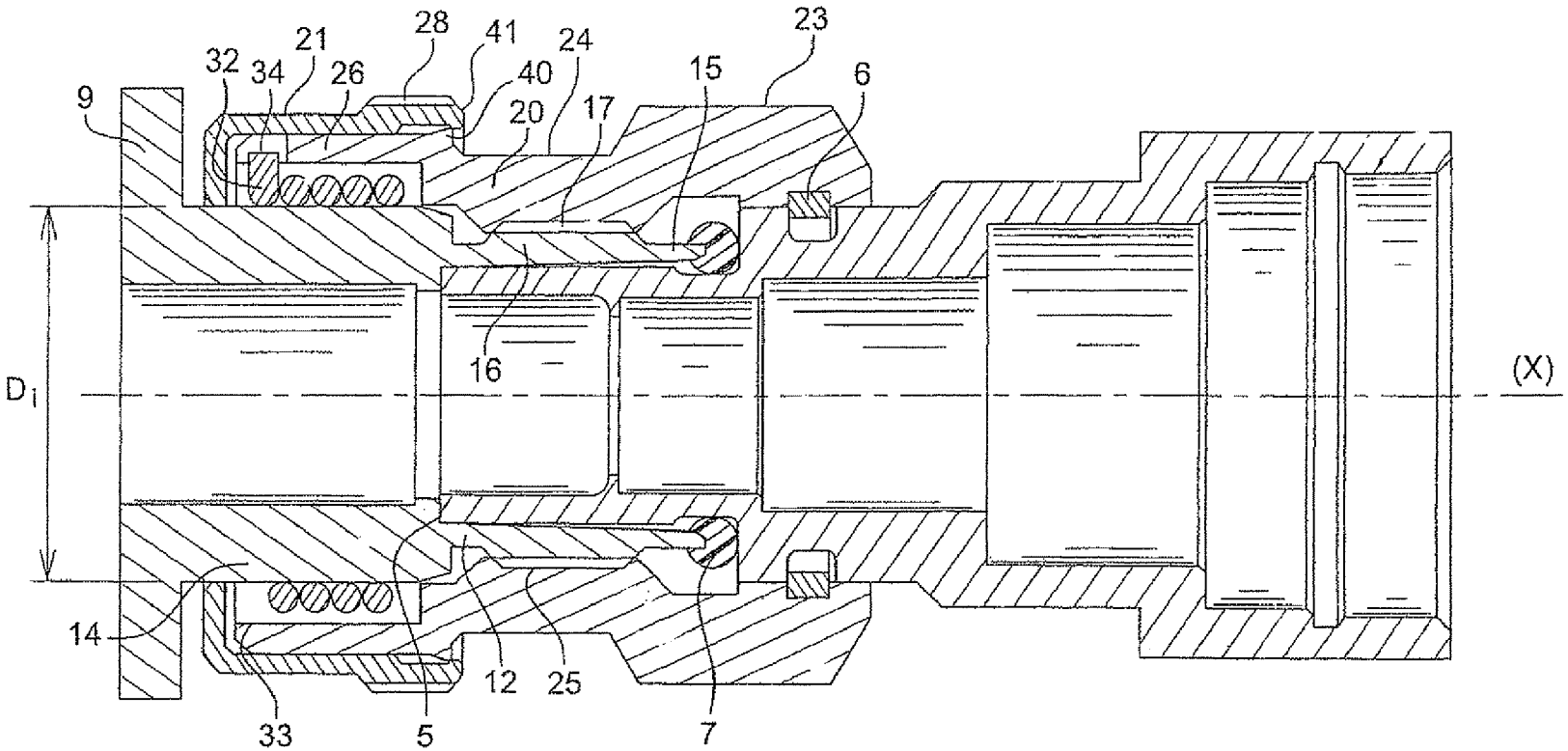
FIGS. 3 and 4 are section views on different longitudinal planes of the FIG. 1 assembly when the two connector elements are connected together.
Figure 4:
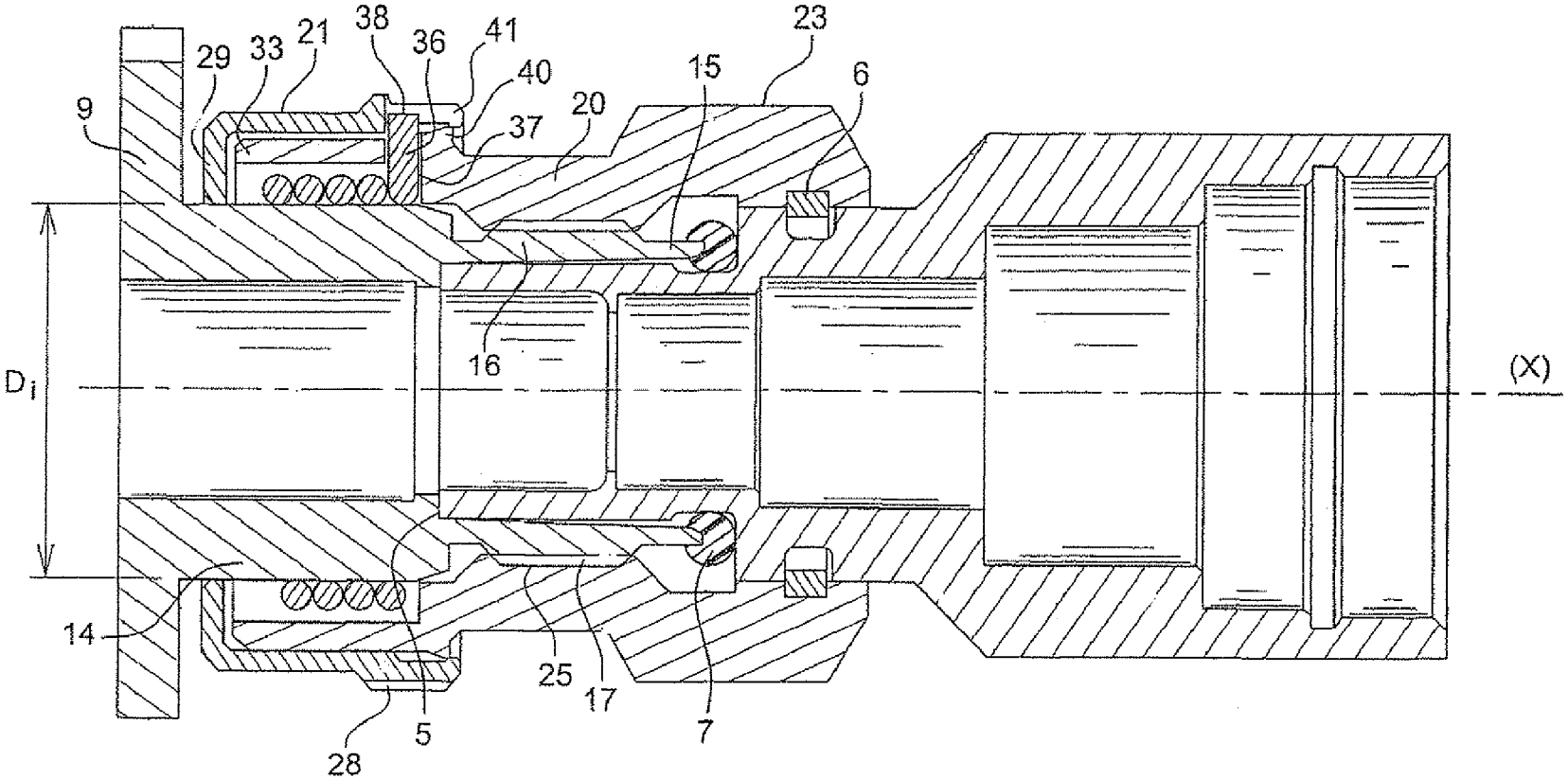

As shown in FIGS. 3 and 4, a first annular housing is formed in the outer side wall of the plug 2 for receiving a clip ring 6, and a second annular housing is formed in the outer side wall of the plug 2 between the above-mentioned first housing and the front end 5 of the plug 2, the second housing receiving an annular gasket 7, e.g. made of silicone.

The socket 3 has a plate 9 for fastening to a panel (not shown), the plate being provided with holes 10 suitable for passing screws, for example. A tubular portion 12 extending around an axis that coincides with the axis X of the plug when the plug 2 is connected to the socket 3 extends from said plate 9 towards the front of the socket 3.

The term "front of the socket" designates the end of the socket that comes into contact with the plug 2 when the plug is connected to the socket. As shown in FIGS. 3 and 4, the tubular portion 12 of the socket 3 includes a fraction 14 extending from the plate 9 and presenting an outside diameter $D_t$, where $D_t$ designates the greatest transverse dimension of the socket 3.

Between the fraction 14 and the front end 15 of the socket, the socket 3 has a fraction 16 that presents an outside thread 17.

There follows a description of an example device 4 for connecting the plug 2 to the socket 3. The device 4 comprises a first part 20, constituted in the example shown by a ring, that is mounted free to turn relative to the plug 2 about the axis X of the plug 2. The first ring 20 may be movable in rotation only about the axis X relative to the plug 2.

In a variant that is not shown, the first ring 20 and the plug 2 are made as a single part.

The device 4 also includes a second part 21 mounted to move in rotation relative to the first ring 20. In the example shown, the second part 21 is a ring, but in a variant it could be a fraction of the ring, said fraction extending to a greater or lesser extent around the axis X.

As can be seen, the first ring 20 may extend all around a fraction of the plug 2, said fraction of the plug 2 extending from the front end 5 thereof. By way of example, the first ring 20 presents an annular bead 23 with its outside surface configured to define a grip zone, this outside surface being obtained by knurling, for example, or by providing a rough zone. In the example shown, the first ring 20 also includes a middle zone 24 in which the inside wall presents a thread 25 for co-operating with the thread 17 described above.

The first ring 20 may include a front portion 26 extending beyond the front end 5 of the plug 2.

In the example described, the second ring 21 extends around the front portion 26 of the first ring 20, the second ring 21 also including a rim 29 covering the front end 33 of the front portion 26. In the example shown, the second ring also includes an annular bead 28 at its end remote from the rim 29 and defining a grip zone obtained in the same manner as the zone 23.

The second ring 21 is held on the first ring 20 by co-operating reliefs 40 and 41 belonging respectively to the first and second rings. In the example described, the first ring 20 is made as a single part, as is the second ring 21.

As shown in the figures, the device 4 includes a spring 30 that is a helical spring in the example described. This spring 30 is received inside the first ring 20, for example.

In the first embodiment of the invention, the winding direction of the spring 30 is reversed relative to the winding direction of the thread 25. By way of example, the thread 25 has a standard right-handed pitch and the spring 30 is wound left-handed.

Figure 2:
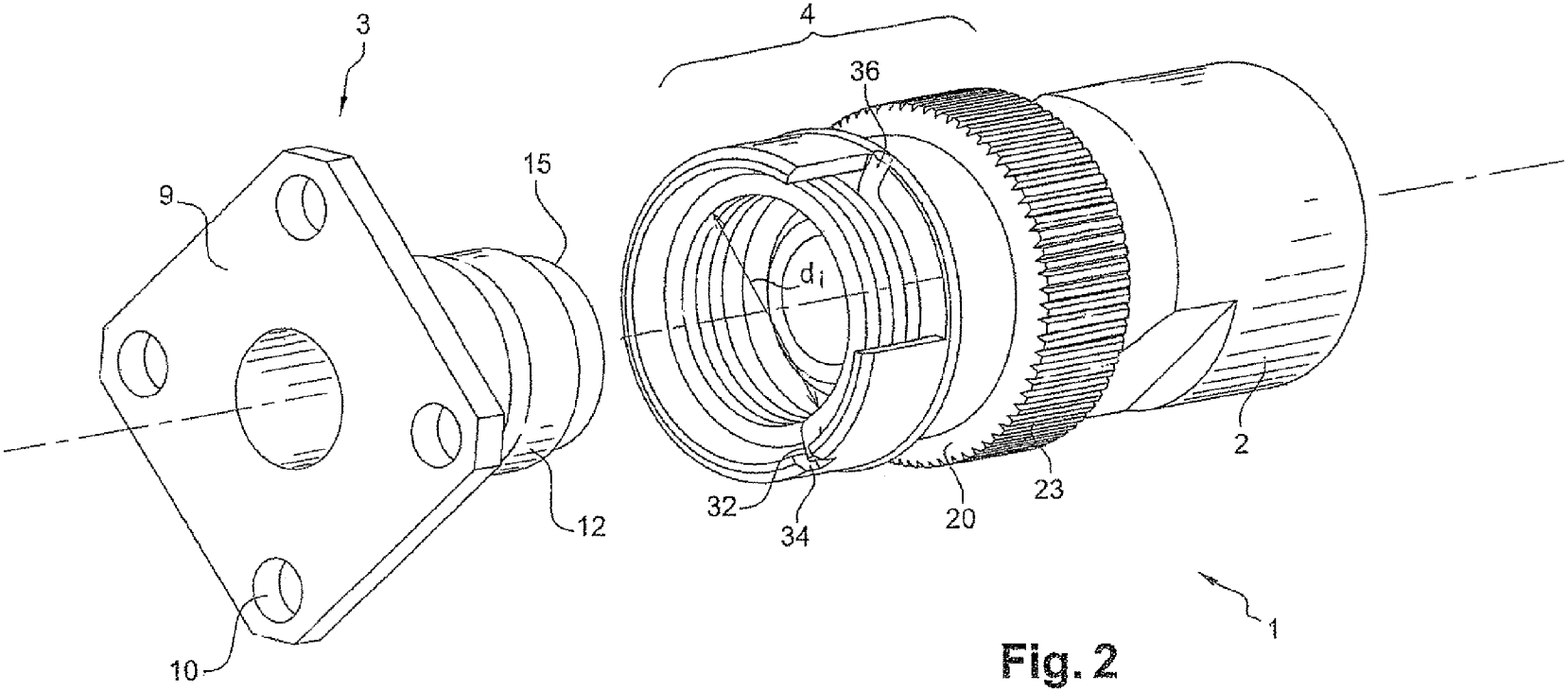
FIG. 2 is a view analogous to FIG. 1 showing an assembly without showing the second part.

As can be seen in FIGS. 2 to 4, the spring presents a first end 32 received in a first hole 34 provided at the front of the front portion 26 of the first ring 20, close to the front end 33 of the front portion 26. The angular dimensions of the first hole 34 are advantageously selected in such a manner that the first end 32 of the spring 30 is held to the first ring by friction, but other means for holding the end 32 on the first ring 20 are also possible. The first hole 34 may be a blind hole or a through hole.

The spring 30 presents a second end 36 passing through a second hole 37 formed in the wall of the front portion 26 at the rear end thereof, the second end 36 being received in a hole 38 that is formed in the bead 28 of the second ring 21. By way of example, the angular dimensions of the second hole 37 are greater than the angular dimensions of the wire of the spring 30, so that the wire passes with a certain amount of lateral clearance through the second hole 37, and the angular dimensions of the hole 38 are advantageously selected in such a manner that the second end 36 of the spring 30 is held on the second ring 21 by friction or by any other means. As shown in the figures, the second hole 37 may be located in such a manner that the first hole 34 is located longitudinally between the front end 33 of the front portion 26 of the first ring 20, and the second hole 37.

By way of example, when at rest, the spring 30 presents an inside diameter $d_i$ that is less than the greatest transverse dimension $D_i$ of the socket 3, this inside diameter $d_i$ being conventionally calculated as being the difference between the outside diameter of the spring and twice the diameter of the spring wire.

There follows a description of an example of connecting the plug 2 to the socket 3 with the help of the device 4.

In a first step, the operator acts on the grip portion 23 of the first ring 20 to move it in rotation in a clockwise direction. As a result of this operation, the inside diameter $d_i$ of the spring 30 increases, enabling the spring 30 to be engaged around the fraction 14 of the socket 3 that has the diameter $D_i$. The angular distance over which the second hole 37 extends in the wall of the first ring 20 is advantageously greater than or equal to the angular rotation of the second end 36 of the spring 30 that enables the inside diameter $d_i$ of the spring 30 to be taken to a value that is greater than the greatest transverse dimension $D_i$ of the socket 3.

During this rotary movement of the grip portion 23, the threads 17 and 25 co-operate, forming a screw-and-nut system.

At the end of this step, the assembly is as shown in FIGS. 3 and 4, the spring 30 then being prestressed against the outside surface of the tubular fraction 14 of the socket 3 as a result of the characteristics of the spring. The front end 15 of the portion 16 of the socket 3 is pressed against the annular gasket 7, thereby guaranteeing sealing of the resulting connection, and the plug 2 is held on the socket 3 by the co-operation between the threads 17 and 25 and by the clamping exerted by the spring 30 on the fraction 14 of the socket 3.

If an operator desires to disconnect the plug 2 from the socket 3, it is not possible to turn the first ring 20 in a counterclockwise direction, since such turning would have the effect of reducing the inside diameter $d_i$ of the spring 30 and would tend to clamp the spring 30 more tightly against the fraction 14 of the socket 3. Thus, instead of enabling the plug to be released from the socket, such action would tend to clamp these two elements together more tightly.

In order to loosen the spring 30, the operator may turn the second ring 21 by turning its bead 28 counterclockwise, thereby increasing the inside diameter $d_i$ of the spring 30, thus allowing the end 36 of the spring to turn in the second hole 37, thereby enabling the spring 30 to move relative to the tubular fraction 14, and consequently enabling the plug 2 to be disconnected from the socket 3.

The invention is not limited to the embodiments described above.

In a second embodiment (not shown), the winding direction of the spring 30 is in the same direction as the winding of the thread 25, e.g. left-handed or right-handed. The first hole 34 is then provided in the wall of the first ring 20 at a distance from the front end 33 of the front portion 26 of the first ring 20, while the second hole 37 and the hole 38 are disposed longitudinally close to the front end 33. In this second embodiment, the second hole 37 is located longitudinally between the front end 33 and the first hole 34.

The angular distance over which the first hole 34 extends in the wall of the first ring 20 is then advantageously greater than or equal to the angle through which the second end 36 of the spring 30 turns to enable the inside diameter $d_i$ of the spring 30 to be brought to a value that is greater than the greatest transverse dimension $D_i$ of the socket 3, and the angular dimensions of the second hole 37 are advantageously selected in such a manner that the first end 32 of the spring 30 is held on the first ring by friction, however other means for holding the end 32 on the first ring 20 are possible.

Figure 5:
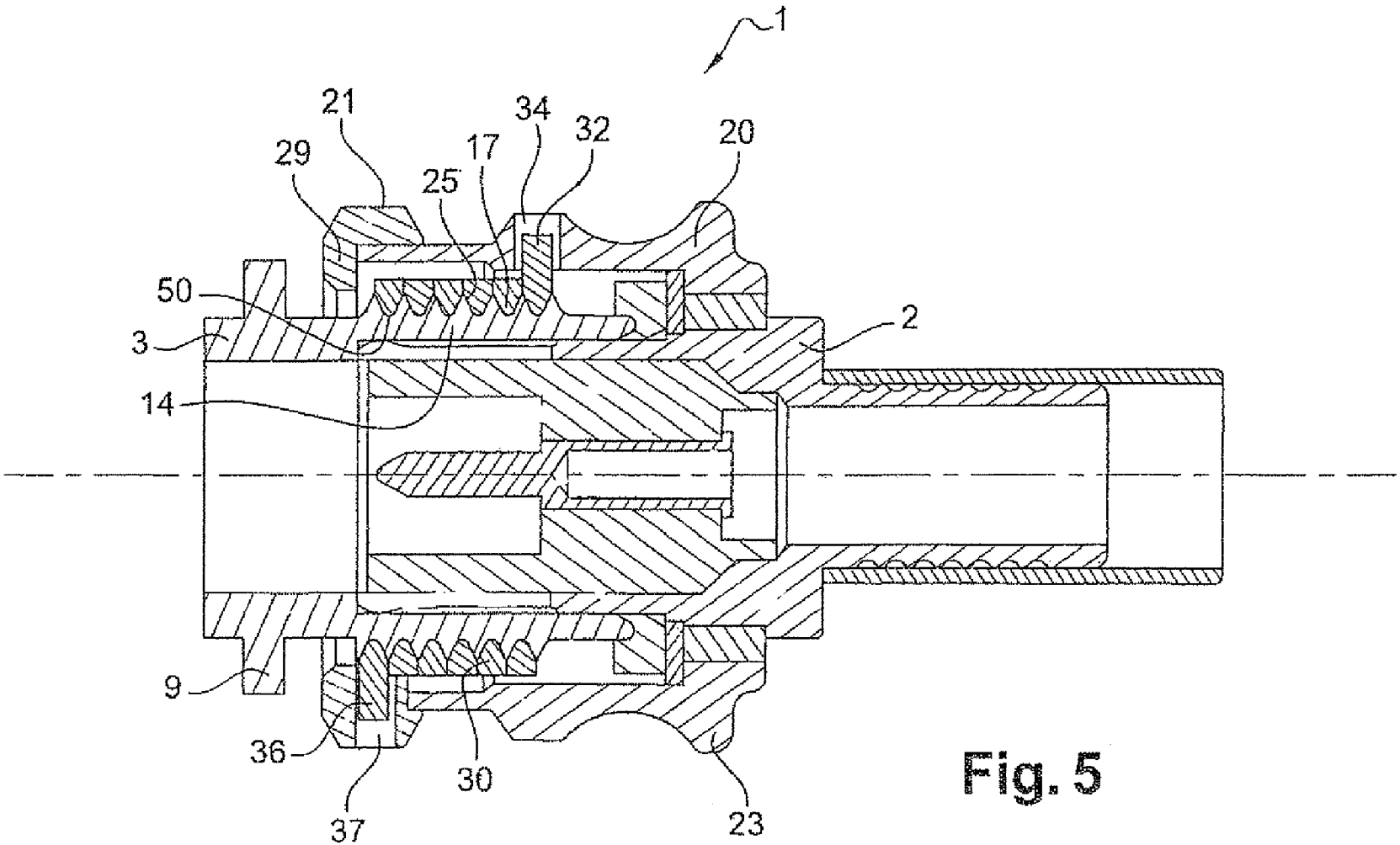
FIG. 5 is a section view of a second embodiment of the invention shown diagrammatically.

FIG. 5 shows a variant of the above-described second embodiment. In the example of FIG. 5, the thread 25 is carried by the spring 30, being formed on the inside surface 50 of the spring 30. The thread 25 in the example described is wound in the same direction as the spring 30 and it is configured to co-operate with the thread 17 carried by the second connector element 3. As can be seen by comparing FIGS. 3 and 5, making the thread 25 with the spring 30 enables the length of the first part 20 to be shortened.

In addition, in the example of FIG. 5, the threaded portion 17 of the second connector element 3 is formed on the outside surface of the portion 14 of diameter $D_i$.

The total weight of the device 4 and of the first connector element 2 may be less than 10 grams (g).

The inside diameter of the spring 30 at rest in the example of FIG. 5 is configured to exert friction on the complementary threaded portion 17.

By way of example, the invention is not limited to a device for connecting together two coaxial connector elements, and it applies equally well to multicontact connector elements, for example.

What is claimed is:

1. A device for connecting together first and second complementary connector elements, the device being distinct from a body of the first connector element and a body of the second connector element, the device comprising:

first and second parts that are movable in rotation relative to each other, and a spring having a first end connected to the first part and a second end connected to the second part; wherein the spring, the first part, and the second part are arranged such that turning the first part in a first direction of rotation, or turning the second part in a second direction of rotation opposite to the first direction of rotation increases an inside diameter of the spring; and the spring, the first part, and the second part are arranged such that turning the first part in the second direction of rotation or turning the second part in the first direction of rotation decreases the inside diameter of the spring.

2. A device according to claim 1, wherein the first part comprises a threaded portion wound in an opposite winding direction to a winding direction of the spring.

3. A device according to claim 2, wherein:

the first part extends along a longitudinal axis, the first end of the spring is received in a first hole formed in a wall of the first part close to a longitudinal end of the first part, and the second end of the spring passes through a second hole formed in the wall of the first part at a distance from said longitudinal end, the first hole being located longitudinally between said first end and the second hole.

4. A device according to claim 1, comprising a threaded portion wound in a same winding direction as a winding direction of the spring.

5. A device according to claim 4, wherein:

the first part extends along a longitudinal axis, the first end of the spring is received in a first hole formed in a wall of the first part at a distance from a longitudinal end of the first part, and the second end of the spring passes through a second hole formed in the wall of the first part close to said longitudinal end, the second hole being located longitudinally between said longitudinal end and the first hole.

6. A device according to claim 4, wherein the threaded portion is provided in the first part.

7. A device according to claim 4, wherein the threaded portion is provided in the spring.

8. A device according to claim 1, wherein the spring is received inside the first and second parts.

9. A device according to claim 1, wherein the spring is a helical spring.

10. A device according to claim 9, wherein the threaded portion is provided in the spring, and wherein the spring is made using a wire of trapezoidal section.

11. A device according to claim 3, wherein the spring is a helical spring, and wherein the second hole presents an angular dimension greater than a diameter of the wire of the spring.

12. A device according to claim 5, wherein the spring is a helical spring, and wherein the second hole presents an angular dimension greater than a diameter of the wire of the spring.

13. A device according to claim 1, wherein the second part comprises at least a portion surrounding the outside of at least a portion of the first part.

14. An assembly, comprising:

a first connector element;

a complementary, second connector element; and a device according to claim 1 mounted on the first connector element and configured to connect the first connector element to the second connector element.

15. An assembly according to claim 14, wherein the inside diameter of the spring at rest is less than a greatest transverse dimension of the second connector element.

16. An assembly according to claim 14, wherein the first connector element and the device are two distinct parts.

17. An assembly according to claim 14, wherein the first and second connector elements are coaxial elements.

18. An assembly according to claim 14, wherein:

the device further comprises a threaded portion provided in the spring wound in a same winding direction as a winding direction of the spring, the second connector element comprises a threaded portion, and a pitch of the spring is selected to co-operate with a pitch of the threaded portion of the second element of the connector.

19. An assembly according to claim 14, wherein:

the device further comprises a threaded portion provided in the spring wound in a same winding direction as a winding direction of the spring, the second connector element comprises a threaded portion, and the inside diameter of the spring at rest is configured to exert friction on the threaded portion of the second connector element.

* * * * *